US005645360A

United States Patent [19]

Iwane et al.

[11] Patent Number: 5,645,360

[45] Date of Patent: Jul. 8, 1997

[54] TAPE CASSETTE USED IN TAPE PRINTING APPARATUS

[75] Inventors: Yasuhiko Iwane; Masahiko Mori, both of Iwate-ken, Japan

[73] Assignee: Alps Electric Co., Ltd., Tokyo, Japan

[21] Appl. No.: 576,360

[22] Filed: Dec. 21, 1995

[30] Foreign Application Priority Data

Dec. 28, 1994 [JP] Japan ..... 6-328090

[51] Int. Cl.[6] ..... B41J 2/315; B41J 32/00

[52] U.S. Cl. ..... 400/613; 400/120.16

[58] Field of Search ..... 400/613.1, 120.16, 400/120.17, 120 HE, 248.2, 615.2, 208, 208.1, 613

[56] References Cited

U.S. PATENT DOCUMENTS

| | | | |
|---|---|---|---|
| 4,568,950 | 2/1986 | Ross et al. | 346/76 PH |
| 4,966,476 | 10/1990 | Kuzuya et al. | 400/208 |
| 5,188,469 | 2/1993 | Nagao et al. | 400/615.2 |
| 5,302,034 | 4/1994 | Kitazawa | 400/120 |
| 5,411,339 | 5/1995 | Bahrabadi et al. | 400/56 |
| 5,435,657 | 7/1995 | Pearce et al. | 400/208 |

*Primary Examiner*—Edgar S. Burr
*Assistant Examiner*—Dave A. Ghatt
*Attorney, Agent, or Firm*—Guy W. Shoup; Patrick T. Bever

[57] ABSTRACT

Disclosed is a tape cassette which requires a small operating space for the attachment and detachment thereof and suitable for use in a thin-type printing apparatus suitable for an integral association with various types of apparatuses. The tape cassette is mounted in a tape printing apparatus equipped with a printing head and a head driving mechanism for driving this printing head and includes a tape-type recording medium accommodated in a cassette body, wherein a cam surface is provided on the surface of the cassette body, the cam surface being adapted to drive the head driving mechanism of the tape printing apparatus when the tape cassette is attached to the tape printing apparatus.

4 Claims, 7 Drawing Sheets

TAPE CASSETTE USED IN TAPE PRINTING APPARATUS

BACKGROUND OF THE INVENTION

1. Field of the Invention

The present invention relates to a tape cassette accommodating a tape-type recording medium, such as a label, on which relatively simple characters, figures, symbols, etc. are to be printed by means of a tape printing apparatus.

2. Description of the Prior Art

Recently, a tape printing apparatus, which is capable of printing relatively simple characters, such as names, or figures, symbols, etc. on a tape-type recording medium called a "label", which consists of a thermosensitive paper, a resin film or the like, has been proposed and found widespread application.

As described in Japanese Patent Laid-Open No. 5-185717, a tape printing apparatus of this type is equipped with an operating section having character inputting keys, printing keys, various kinds of function keys, etc. for inputting characters, symbols, figures, etc., a display section consisting of a liquid crystal device or the like for displaying the input characters, etc., and a cassette accommodating section accommodating a tape cassette containing a tape-type recording medium, and performs printing on the tape-type recording medium by means of a printing head, such as a thermal head, on the basis of input printing data while feeding the tape-type recording medium.

The portion of the tape-type recording medium on which printing has been completed is put out to the exterior of the tape printing apparatus and cut off by the operator, thereby providing a piece of recording medium on which predetermined characters, symbols, figures or the like have been printed. This piece of tape-type recording medium, which has thus undergone printing and been cut off, is attached to the back or front side of a video cassette and used as an index or the like of the video cassette.

Such a tape-type recording medium for use in a tape printing apparatus is accommodated alone in a case to form a tape cassette when the recording medium is a thermal sensitive paper; when the recording medium is one which does not develop color as in the case of a plastic film, it is accommodated in a case together with an ink ribbon to form a tape cassette. The tape-type recording medium, which is let out from the tape cassette by a requisite amount (length) for use from the tape cassette and subjected to printing. The tape cassette is attached to a cassette accommodating section provided in a printing section of a tape printing apparatus.

The tape cassette is enabled to be attached to or detached from the tape printing apparatus by opening a cover of the cassette accommodating section, which is provided on the (upper) surface of the tape printing apparatus.

As described above, in the conventional tape printing apparatus, which is formed as a separate unit intended for individual use, the tape cassette is attached to or detached from the tape printing apparatus by opening the cover of the tape printing apparatus, which means the attachment and detachment of the tape cassette to and from the tape printing apparatus must be conducted in a space large enough to allow the cover to be opened. Thus, when the tape printing apparatus is installed in a small space, such as the interior of a rack or the like, it is impossible to secure the requisite operating space for the opening and closing of the cover, with the result that the attachment and detachment of the tape cassette to and from the tape printing apparatus is impossible.

Further, nowadays, the title or the like of a piece of recorded information stored on a video tape is often printed on a piece of tape-type recording medium, and this piece of recording medium, having the title thus printed thereon, is affixed to the video cassette. Due to the recent increase in this type of use of the tape printing apparatus, there is a demand for a VTR (video cassette tape recorder) having a tape printing apparatus integrally provided thereon.

However, as stated above, to attach or detach the tape cassette to or from the tape printing apparatus, it is necessary to open the cover of the apparatus. Thus, when the tape printing apparatus is mounted on the VTR (i.e., when the printing apparatus and the VTR are formed into an integral unit), the tape printing apparatus cannot be arranged on the upper side of the VTR if the VTR is to be installed in the interior of a rack or the like. On the other hand, if the tape printing apparatus is arranged on the vertical front side of the VTR so that the opening and closing of the cover can be effected on the front side of the VTR, an increase in the requisite mounting area for the tape printing apparatus with respect to the front side of the VTR and in the height of the VTR is entailed, with the result that the size of the VTR as a whole becomes rather large.

Under the circumstances, there is a demand for a tape printing apparatus which requires a small operating space for the attachment and detachment of the tape cassette and which is suitable to be integrally associated with various apparatuses. There is also a demand for a tape cassette for use in such a tape printing apparatus.

SUMMARY OF THE INVENTION

It is accordingly an object of the present invention to provide a tape cassette suitable for use in a thin-type tape printing apparatus which requires a small operating space for the attachment and detachment of the tape cassette and which is suitable for use in a thin-type tape printing apparatus suitable to be integrally associated with an electronic apparatus, such as a VTR.

Another object of the present invention is to provide a tape cassette which is mounted in a tape printing apparatus equipped with a printing head and a head driving mechanism for driving this printing head and which includes a cassette body accommodating a tape-type recording medium, wherein the cassette body is equipped with a cam surface for driving the head driving mechanism of the tape printing apparatus when the tape cassette is attached to the tape printing apparatus.

Still another object of the present invention is to provide a tape cassette having a platen roller which abuts against the printing head of the tape printing apparatus through the intermediation of the tape-type recording medium when the tape cassette is attached to the tape printing apparatus.

A further object of the present invention is to provide a tape cassette having a platen roller driving gear for driving the platen roller which is connected, when the tape cassette is attached to the tape printing apparatus, with a driving force transmitting mechanism and capable of transmitting the driving force of a driving motor provided in the tape printing apparatus.

In accordance with the present invention, the head driving mechanism of the tape printing apparatus can be driven by the cam surface of the tape cassette when the tape cassette is attached to the tape printing apparatus.

Further, in accordance with the present invention, the tape cassette is driven simply by attaching it to the cassette attachment section, with the printing head being brought into abutment with the platen roller of the tape cassette through the intermediation of the tape-type printing medium.

Moreover, in accordance with the present invention, by attaching the tape cassette to the cassette driving section, the driving force transmitting mechanism is connected with the platen driving gear for rotating the platen roller, and the driving force of the driving motor can be transmitted to the platen roller provided in the tape cassette.

DETAILED DESCRIPTION OF THE PREFERRED EMBODIMENTS

Figure 1:
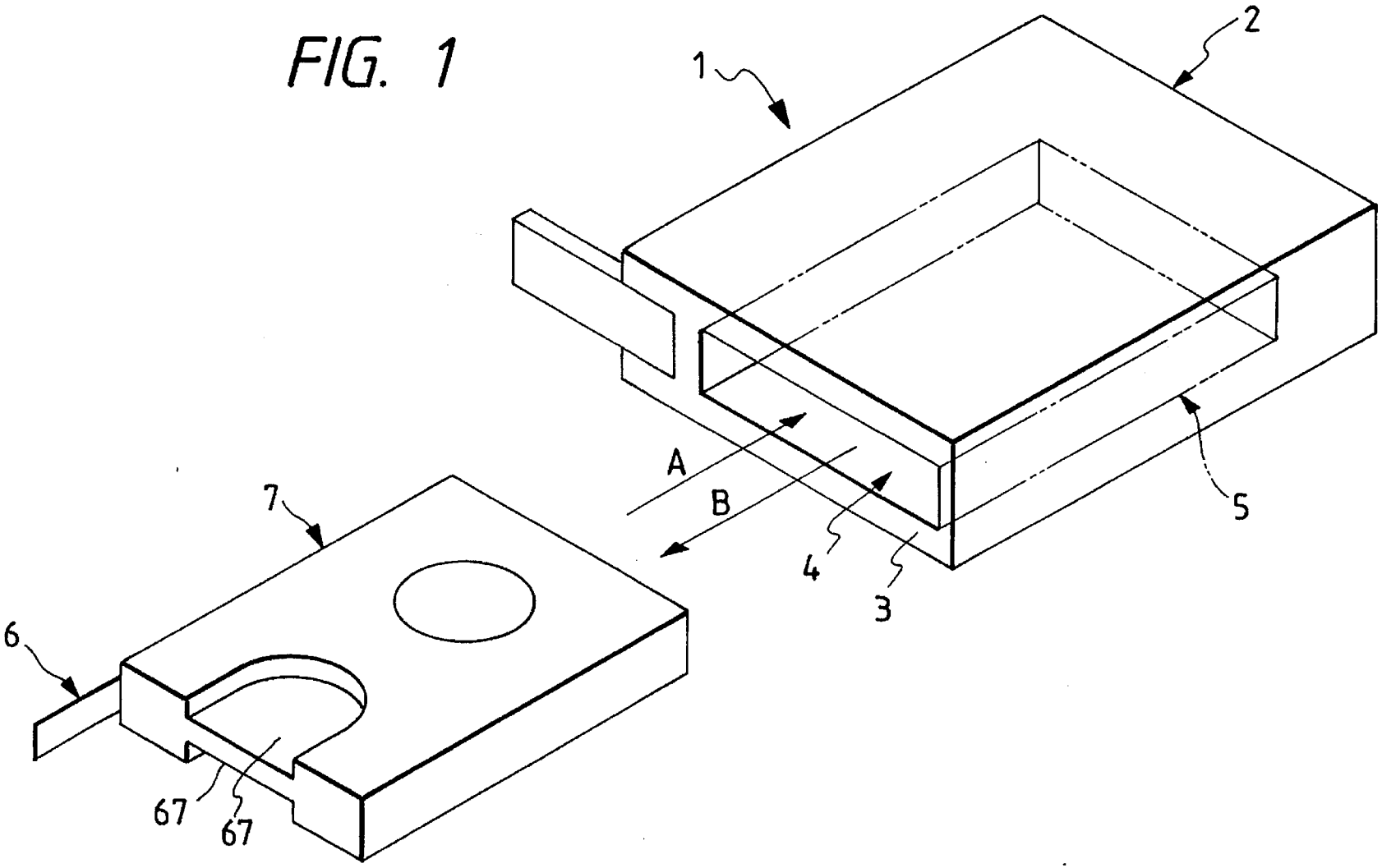
FIG. 1 is an overall perspective view showing the construction of a tape printing apparatus to which a tape cassette according to the present invention is to be applied.

The present invention will now be described with reference to an embodiment shown in the drawings.

First, the construction of a tape printing apparatus using a tape cassette according to the present invention will be schematically described with reference to FIG. 1.

As shown in FIG. 1, a tape printing apparatus 1 of this embodiment has a box-shaped main body 2. Of the side surfaces of this main body 2, one side surface, which is the left-hand side as seen in FIG. 1, is formed as a front side 3 constituting an operating side. In this front side 3, a cassette insertion opening 4 having a rectangular configuration in front view is formed so as to extend parallel to the longitudinal dimension of the front side 3 of the main body 2. Inside the main body 2, a cassette attachment section 5 is formed so as to communicate with the cassette insertion opening 5 as indicated by a phantom line in FIG. 1.

A tape cassette 7 which accommodates a tape-type recording medium 6, one end of which can be led to the exterior, can be attached to the cassette attachment section 5 through the cassette insertion opening 4 formed in the front side 3 of the main body 2, as indicated by arrows A and B in FIG. 1. That is, in the tape printing apparatus of this embodiment, the attachment and detachment of the tape printing apparatus 1 is effected through the front side 3 of the main body 2. In FIG. 1, the arrow A indicates the attaching direction, and the arrow B indicates the extracting direction, of the tape cassette 7.

The tape printing apparatus 1 of this embodiment is mounted in a VTR (video tape recorder) 72 described below.

Next, the tape printing apparatus of this embodiment will be described in more detail with reference to FIGS. 2 through 5.

Figure 2:
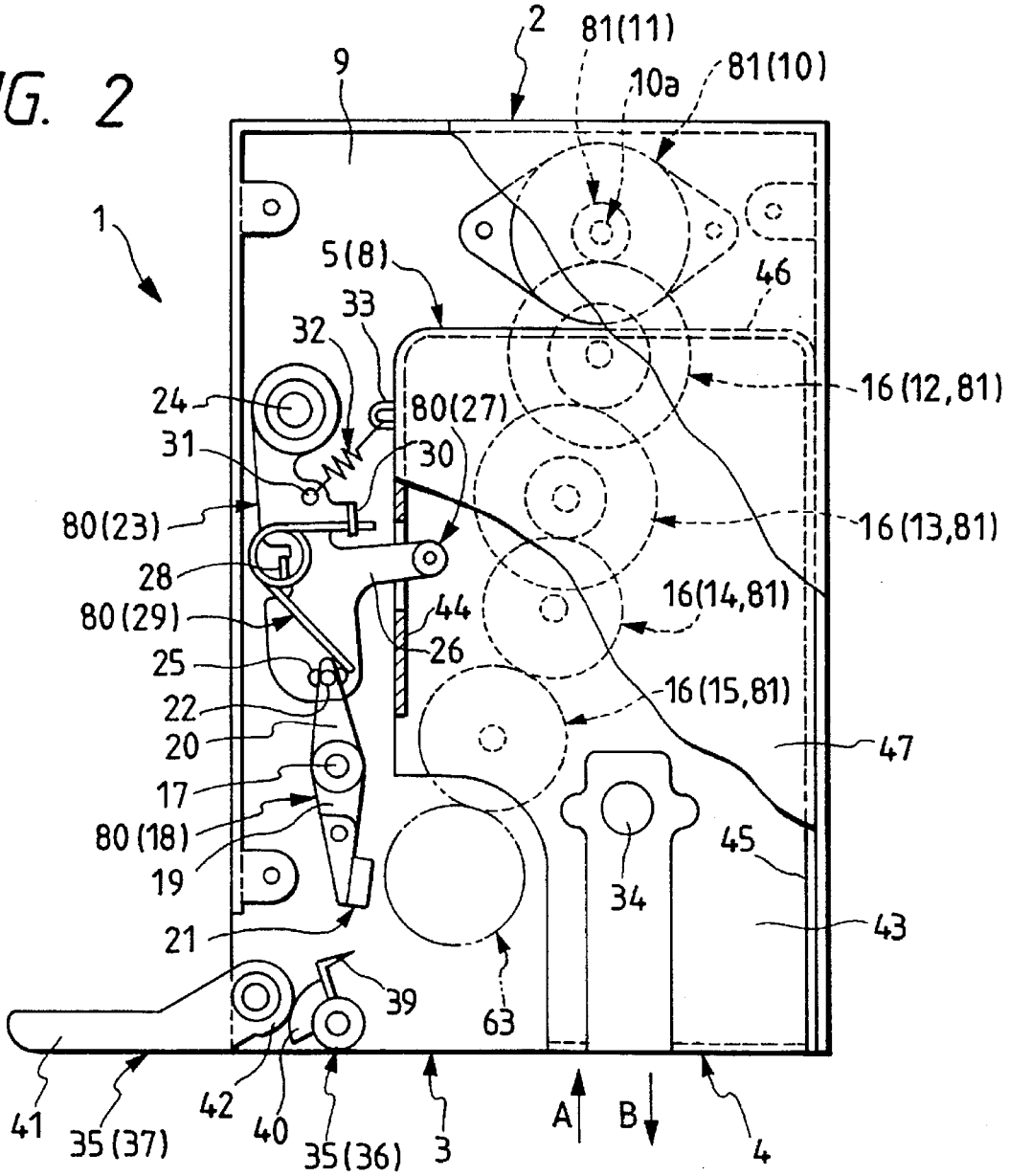
FIG. 2 is a partially cutaway plan view showing the construction of the essential part of a tape printing apparatus to which a tape cassette according to the present invention is to be applied.
Figure 3:
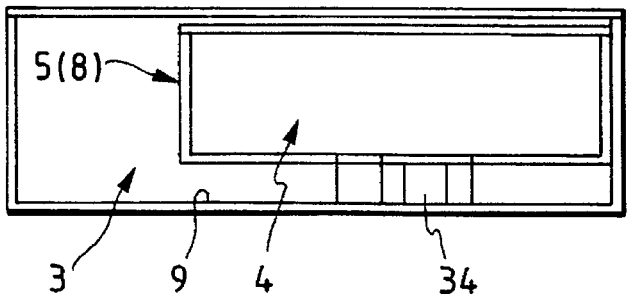
FIG. 3 is a partially omitted front view showing the essential part of the apparatus of FIG. 2.
Figure 4:
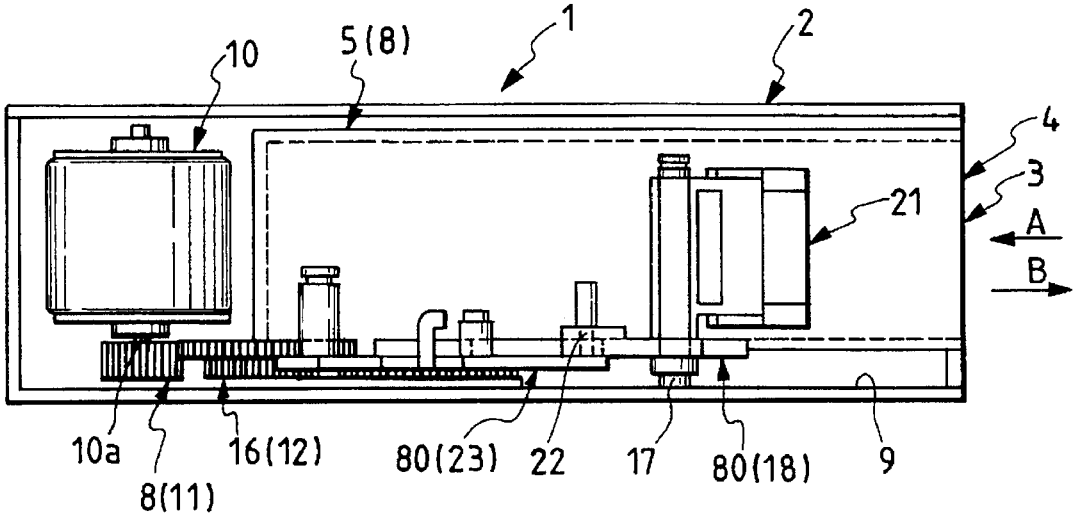
FIG. 4 is a side view as seen from the left-hand side in FIG. 2, showing the inner construction of the essential part of the apparatus.

As shown in FIGS. 2 through 4, a tape printing apparatus 1 according to this embodiment has a main body 2, which is box-shaped and substantially rectangular in plan view. Of the side surfaces of this main body 2, one side surface, which is the lower side surface as seen in FIG. 2, is formed as a front side 3 constituting the operating side and, in this front side 3, a cassette insertion opening 4, having a rectangular configuration in front view, is formed so as to extend parallel to the longitudinal dimension of the front side 3 of the main body 2. Inside the main body 2, an internal case 8, which constitutes the cassette attachment section 5, is formed so as to communicate with the cassette insertion opening 4 on the front side 3.

As shown in FIGS. 2 through 5, a driving motor 10 is arranged over the right innermost section (as seen in FIG. 2) of a bottom surface 9 of the interior of the main body 2, with its output shaft 10*a* pointed downward. A driving gear 11 is mounted on this output shaft 10*a* (FIG. 4). This driving gear 11 is connected (in mesh) with an input gear 12 arranged at a position nearer to the front side 3 than the driving gear 11 and consisting of a double gear (composed of large and small gears) rotatably supported on the bottom surface 9. This input gear 12 is connected (in mesh) with a first intermediate gear 13 arranged at a position nearer to the front side 3 than the input gear 12 and consisting of a double gear rotatably supported on the bottom surface 9. Further, the first intermediate gear 13 is connected (in mesh) with a second intermediate gear 14 arranged at a position nearer to the front side 3 than the first intermediate gear 13 and rotatably supported on the bottom surface 9, and the second intermediate gear 14 is connected (in mesh) with an output gear 15 arranged at a position nearer to the front side 3 than the second intermediate gear 14 and rotatably supported on the bottom surface 9. The gears 12, 13, 14 and 15, connected with the driving gear 11, are arranged substantially in a row toward the front side 3 so that the driving force of the driving motor 10 is sequentially transmitted. When the cassette is attached to the apparatus, the output gear 15 can be connected with a platen driving gear 63 described below, which is arranged in the tape cassette 7.

The input gear 12, the first intermediate gear 13, the second intermediate gear 14 and the output gear 15 constitute a driving force transmitting mechanism 16 according to this embodiment.

The driving motor 10, the driving force transmitting mechanism 16, a platen roller 60 arranged in the tape cassette 7 and described below, and the platen driving gear 63 constitute a tape running mechanism 81 according to this embodiment.

To the left (as seen in FIG. 2) of the the output gear 15, a head lever 18 is arranged, with the substantially middle section with respect to the longitudinal direction of this head lever 18 being rotatably supported by a support axle 17 projecting from the bottom surface 9. This head lever 18, which is substantially formed as a plate, is arranged so as to extend substantially parallel to the bottom surface 9. Further, the head lever 18 has a front arm 19 positioned on the side of the front side 3 with respect to the support axle 17 and a back arm 20 positioned on the inner side of the main body 2 with respect to the support axle 17, and is arranged to extend longitudinally (or, vertically, as seen in FIG. 2) so as to be rotatable on the support axle 17.

On the upper surface on the free-end side of the front arm 19 of the head lever 18, a thermal head 21, serving as the printing head, is arranged, which consists of a plurality of lined-up heat generating elements (not shown). In the state in which the cassette is attached to the printing apparatus, this thermal head 21 can be brought into abutment with or separated from the outer peripheral surface of the platen roller 60, arranged in the tape cassette 7 and described below, by the rotation of the head lever 18 around the support axle 17. Further, on the lower surface near the free end of the back arm 20 of the head lever 18, there is provided an engagement pin 22 which protrudes toward the bottom surface 9.

Figure 5:
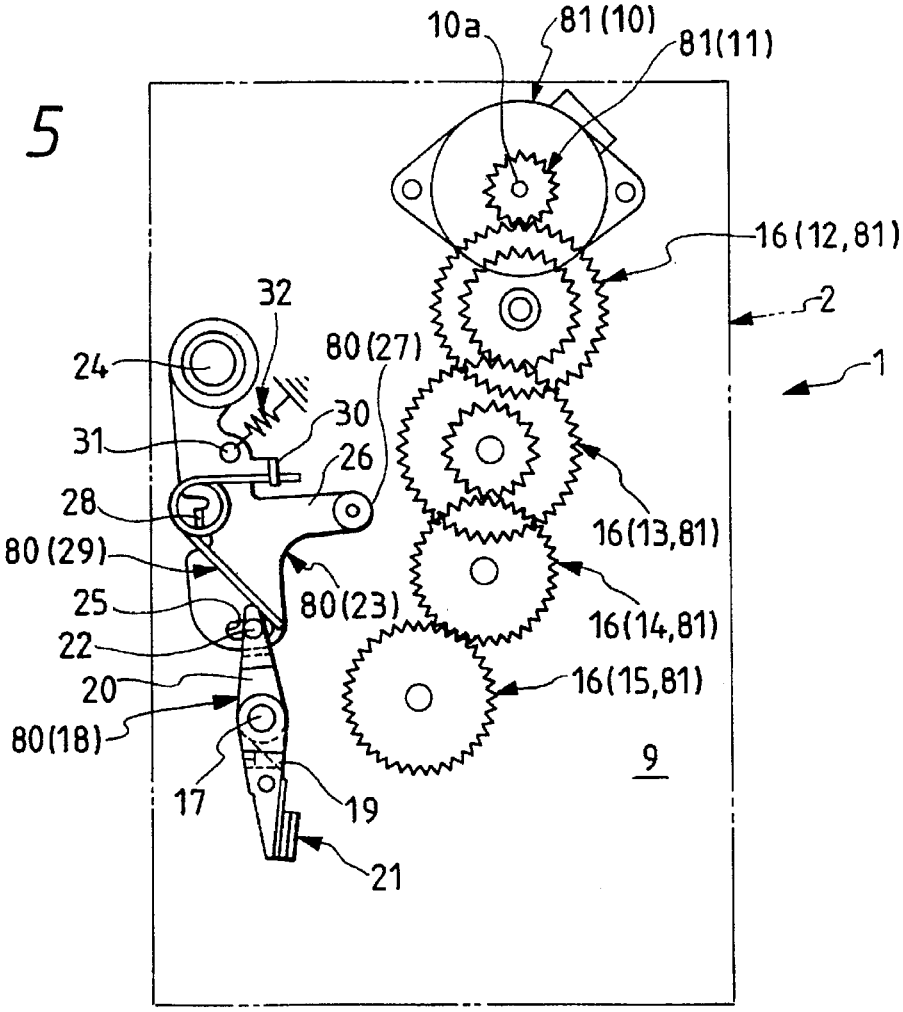
FIG. 5 is a partially omitted plan view showing the inner construction of the essential part of a tape printing apparatus to which a tape cassette according to the present invention is to be applied.

As shown in FIGS. 2 and 5, on the inner side with respect to the head lever 18, there is arranged a head lever 23 in the form of a plate for causing the thermal head 21, attached to the head lever 18, to operate so as to be brought into abutment with or separated from the platen roller 60, arranged in the tape cassette 7 and described below, in the condition in which the cassette is attached to the apparatus. The base portion of this head lever arm 23, which extends substantially parallel to the bottom surface 9, is rotatably supported on a rotation axle 24 protruding from the left inner section of the bottom surface 9, and the free end of this head lever driving arm 23 is arranged below the free end of the back arm 20 of the head lever 18.

In the vicinity of the free end of the head lever driving arm 23, there is formed an arcuate elongated hole 25, into which the pin 22, protruding from the lower surface of the free-end portion of the back arm 20 of the head lever 18, is fitted, whereby the range of rotation of the head lever 18 around the support axle 17 is restricted. Further, in the substantially middle portion with respect to the longitudinal dimension of the head lever driving arm 23, a sub-arm 26 is formed, which extends to the right as seen in FIGS. 2 and 5, and, on the upper surface of the forward end section of this sub-arm 26, a rotatable cam follower 27 in the form of a roller is arranged. In the condition in which the cassette is attached to the printing apparatus, this cam follower 27 abuts a cam surface 65, described below, of the tape cassette 7 so that the head lever driving arm 23 can rotate clockwise (as seen in FIGS. 2 and 5) around the rotation axle 24. Further, a spring support section 28 protrudes from the left-hand upper surface of the substantially middle section with respect to the longitudinal dimension of the head lever driving arm 23, and the forward edge of this spring support section 28 is engaged with a torsion coil spring 29 such that they abut each other.

The lower end as seen in FIGS. 2 and 5 of the torsion coil spring 29 is engaged with the right-hand side of the forward end section of the back arm 20 of the head lever 18 such that it can bias the head lever 18 clockwise, and the other end, that is, the upper end as seen in FIGS. 2 and 5 of the torsion coil spring 29 is in abutting engagement with the forward edge of an engagement protrusion 30 provided on the inner side of the main body 2 with respect to the base section of the sub-arm 26 of the head lever driving arm 23.

As shown in FIGS. 2 and 5, in that portion of the head lever driving arm 23 which is in the vicinity of the base section thereof, a through-hole 31 extending along the plate-thickness dimension is formed, and this through-hole 31 is engaged with one end of a biasing spring 32 for constantly biasing the head lever driving arm 23 counterclockwise as seen in FIGS. 2 and 5 around the rotation axle 24. The other end of this biasing spring 32 is engaged with a spring engagement member 33 (FIG. 2) provided on the bottom surface 9.

The head lever 18, the head lever driving arm 23, the cam follower 27, and the torsion coil spring 29 constitute a head driving mechanism 80 of this embodiment.

In this embodiment, the cam follower 27 is displaced to the left as seen in FIGS. 2 and 5 to thereby rotate the head lever driving arm 23 clockwise as seen in FIGS. 2 and 5 around the rotation axle 24 and, as the head lever driving arm 23 thus rotates clockwise, the lower end as seen in FIGS. 2 and 5 of the torsion coil spring 29 causes the forward (free) end of the back arm 20 of the head lever 18 to move to the left, whereby the head lever 18 can be rotated counterclockwise as seen in FIGS. 2 and 5 around the support axle 17 by virtue of the resilient force of the torsion coil spring 29.

As shown in FIG. 2, to the right of the output gear 15, a substantially cylindrical engagement protrusion 34, which is used for positioning the tape cassette 7, etc. when the cassette is attached to the apparatus, stands erect, and, on that section of the bottom surface 9 which is in the vicinity of the left-hand end of the front side 3, a tape cutting mechanism 35 for cutting off the tape-type recording medium 6 by a desired length is provided.

As shown in FIG. 2, the tape cutting mechanism 35 has a cutting base member 36 and a cutter lever 37 for operating this cutting base member 36. This cutting base member 36 has a base section rotatably supported on the bottom surface 9 and having a substantially circular plan-view configuration. On the outer peripheral surface of this base member 36, a cutter 39 for cutting the tape-type recording medium in a direction substantially perpendicular to the longitudinal dimension thereof is provided so as to face a cutter receiving section 66 provided on a side of the tape cassette 7 and described below. The outer peripheral surface of the base member 36 is arranged at a position spaced apart from the side surface of the tape cassette 7 in the condition in which the cassette is attached to the apparatus in order that it may not hinder the running of the portion of tape-type recording medium 6 which has undergone printing and is to be sent out from the tape cassette 7. Further, on that end surface of the base member 38 which faces the bottom surface 9, a substantially fan-shaped cutter driving gear 40 is mounted so as to be coaxial with the base member 36.

The above-mentioned cutter lever 37 is rotatably supported on the left-hand front end section of the bottom surface 9 of the main body 2. Formed on this cutter lever 37 are an operating arm 41 protruding out of the main body 2 and adapted to be manually operated and a gear section 42 that is in mesh with the above-mentioned cutter driving gear 40.

In this embodiment, the operating arm 41 of the cutter lever 37 is drawn toward the viewer of FIG. 2 (that is, rotated counterclockwise), whereby the gear section 42 of the cutter lever 37 is rotated counterclockwise as seen in FIG. 2; the cutter driving gear 40, connected with this gear section 42, rotates clockwise as seen in FIG. 2, and the cutter, coaxially mounted on the cutter driving gear 40, rotates clockwise as seen in FIG. 2, and, in the condition in which the cassette is attached to the apparatus, moves toward the cutter receiving section 66, provided on a side surface of the tape cassette 7, so as to cut the tape-type recording medium by a desired length.

Over the above-described driving force transmitting mechanism 16, an internal case 8, serving as the cassette attachment section 5 and formed as a case with an opening oriented in the same direction as the front side 3, is provided so as to communicate with the cassette insertion opening 4. This internal case 8 is supported above the bottom surface 9 by means of a plurality of support ribs (not shown) protruding from the bottom surface 9 so as not to interfere with the operation of the components described above, and is composed of a bottom plate 43 for supporting the lower surface of the tape cassette 7 in the condition in which the cassette is attached to the apparatus and serving as a guide for the lower surface, left and right side plates 44 and 45 for laterally positioning the tape cassette 7 and serving as a guide thereof, a back plate 46, and a top plate 47. The above-mentioned plates 43, 44, 45, 46 and 47 are formed so as to be partially open in order that they do not interfere with the operation of the components of the tape cassette 7 described below.

The construction of the internal case 8 of the cassette attachment section 5 is not particularly restricted to that of this embodiment; the upper side and the right-hand side of the main body 2 may substitute as the top plate 47 and the right-hand side plate 45. Further, it is also possible for the internal case 8 to be attached to the top side of the main body 2. Thus, the construction of this embodiment should not be construed restrictively; any construction will do as long as it does not interfere with the operation of the components arranged on the bottom surface 9 of the interior of the main body 2.

Further, an operating section 48 for manually inputting printing information (not shown), a printing information storing section 50 for storing printing information, a printing control section 51 for selectively causing the heat generating elements, arranged on the thermal head 21, to generate heat on the basis of printing information and for controlling the driving motor 10, a display section 49 for displaying printing information, etc. are provided in a VTR 72 described below, on which the tape printing apparatus 1 of this embodiment. The printing control section 51 is composed of a CPU, memory, etc. (not shown).

Figure 6:
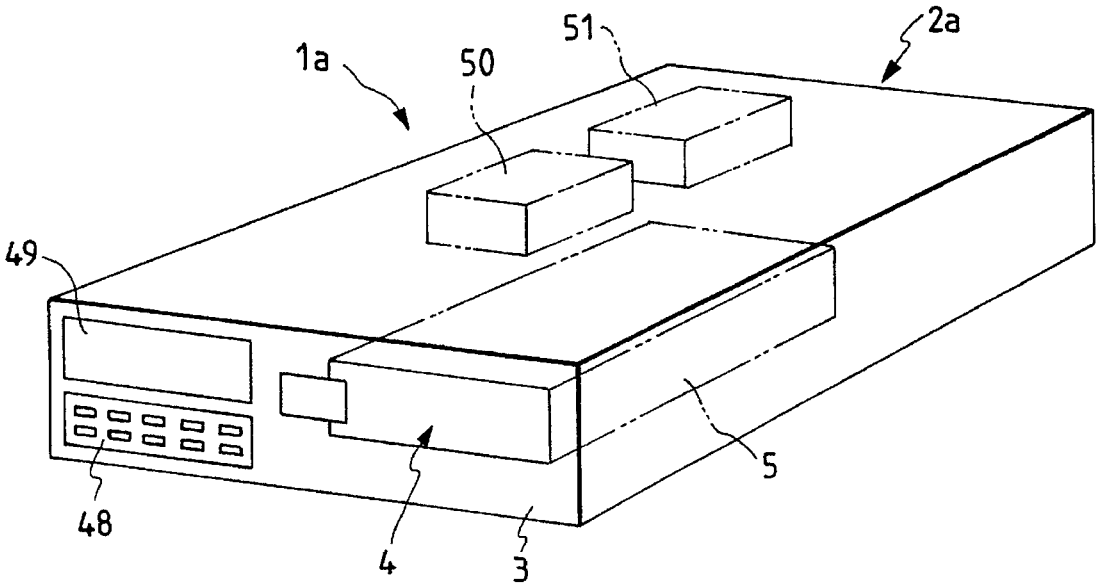
FIG. 6 is an overall perspective view showing the construction of a modification a tape printing apparatus to which a tape cassette according to the present invention is to be applied.

As shown in FIG. 6, components, such as the operating section 48 for manually inputting printing information to the tape printing apparatus 1*a* and the display section 49 serving to display the input characters, etc. and consisting of liquid crystal elements or the like are arranged on the front side 3 of the main body 2*a*. As indicated by a phantom line in FIG. 6, the printing information storing section 50 for storing printing information and the printing control section 51 for selectively causing the heat generating elements, arranged on the thermal head 9, to generate heat on the basis of printing information and for controlling the driving motor 10 are provided inside the main body 2*a*. Apart from the above, the apparatus has the same construction as the tape printing apparatus 1 of the above-described embodiment.

When the tape printing apparatus 1 forms an integral unit with some other apparatus, such as a VTR, the main body of this other apparatus may constitute the main body 2 of the tape printing apparatus 1.

Next, an embodiment of the tape cassette of the present invention will be described with reference to FIGS. 7 and 8.

Figure 7:
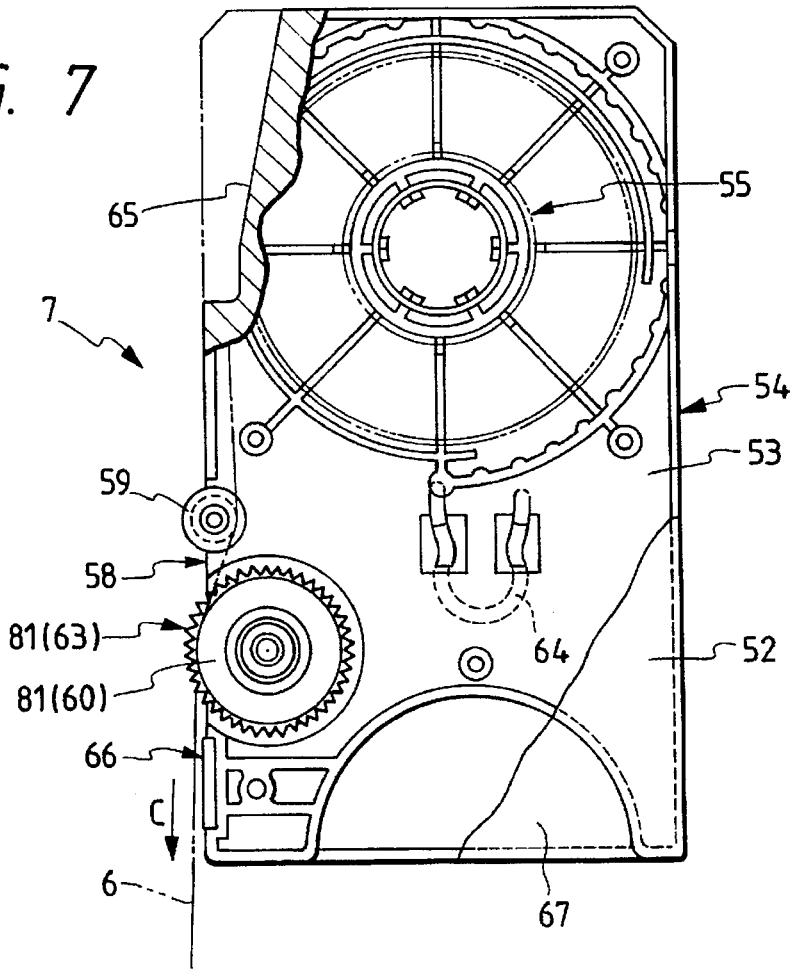
FIG. 7 is a plan view showing the essential part of a tape cassette according to the present invention, with a part of its upper case removed.
Figure 8:
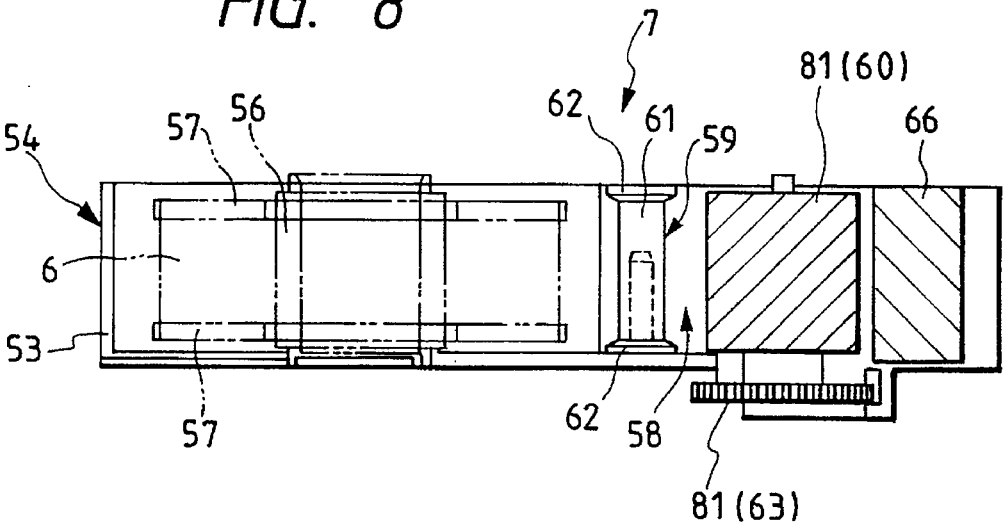
FIG. 8 is a left-hand side view of the tape cassette of FIG. 7 as seen from the platen roller side.

As shown in FIGS. 7 and 8, the tape cassette 7 of this embodiment includes a cassette main body 54 composed of a pair of (upper and lower) cover cases 52 and 53 and having a substantially rectangular configuration in plan view. In the upper section (as seen in FIG. 7) of the interior of the cassette main body 54, a tape reel 55 is rotatably supported.

As shown in FIG. 8, the tape reel 55 has an attachment base section 56 having a cylindrical configuration. In the vicinity of the end sections of the outer peripheral surface of this attachment base section 56, flange sections 57 extending parallel to each other and having a circular plan-view configuration are formed so as to be perpendicular to the axis of the attachment base section 56. The tape-type recording medium 6 is wound around the outer peripheral surface of the attachment base section 56 positioned between the flanges 57.

In the lower section of the left-hand side (as seen in FIG. 7) of the sides of the cassette main body 54, there is provided a tape outlet 58 for allowing one end (the free end) of the tape-type recording medium 6 to be let out to the exterior of the cassette main body 54.

In the vicinity of the tape outlet 58 and at a position on one side with respect to the longitudinal direction (the upper side as seen in FIG. 7) of this tape outlet, a tape guide 59 for guiding the tape-type recording medium 6 is provided. On the other side (i.e., the lower side as seen in FIG. 7) with respect to the longitudinal dimension of the tape outlet 58, there is provided a rotatably supported platen roller 60, with a part of its outer peripheral surface protruding out of the tape outlet 58.

As shown in FIG. 8, the tape guide 59 has a base section 61 having a cylindrical configuration, and, in the vicinity of the end sections of the outer peripheral surface of this base section 61, flange members 62, which extend parallel to each other and which have a circular plan-view configuration, are formed so as to be perpendicular to the axis of the base section 61. That section of the outer peripheral surface of the base section 61 which is between the flanges 62 is brought into contact with the tape-type recording medium 6 to serve as a guide thereof. The above-described construction of this embodiment should not be construed restrictively; for example, the tape guide 59 may be rotatably supported by the cassette main body 54. Further, the tape guide 59 of this embodiment is formed so as to be replaceable as needed according to the distance between the flange members 62, which varies with the width of the tape-type recording medium 6. That is, by replacing the tape guide 59, it is possible for a single tape cassette 7 to be applied to a variety of tape-type recording media 6 with different widths.

At least the outer peripheral surface of the platen roller 60 is formed of an elastic material, such as rubber, to constitute a rubber roller. In the condition in which the cassette is attached to the apparatus, the thermal head 21 of the tape printing apparatus 1 can be brought into abutment with the platen roller 60 through the intermediation of the tape-type recording medium 6. The position at which the thermal head 21 and the platen roller 60 abut each other constitutes the printing position. A platen driving gear 63 for rotating the platen roller 24 is coaxially mounted under the platen roller 60 so as to be integrally rotatable with the platen roller 60. In the condition in which the cassette is attached to the apparatus, this platen driving gear 63 can be connected (engaged) with the output gear 15 provided in the tape printing apparatus 1.

One end (the free end) of the tape-type recording medium 6, wound around the outer peripheral surface of the tape reel 55, is led out from the tape outlet 58 by way of the tape guide 59, and is guided outwardly in the tape running direction indicated by an arrow C in FIG. 7, i.e., along that portion of the outer peripheral surface of the platen roller 60 which is exposed to the exterior through the tape outlet 58.

Substantially at the center of the lower surface of the lower case 53 of the cassette main body 54, an elastic protrusion 64 having a substantially U-shaped configuration is provided so as to be exposed on the lower side of the cassette main body 54. When the cassette is attached to the apparatus, this protrusion 64 is fitted onto the outer peripheral surface of the engagement protrusion 34 of the tape printing apparatus 1, whereby the positioning of the tape cassette 7, attached to the cassette attachment section 5, is effected and, further, by virtue of the resultant click, the operator can make sure that the attachment of the tape cassette 7 to the cassette attachment section 5 has been completed.

In the upper left corner as seen in FIG. 7 of the lower cover case 53 of the cassette main body 54, a recessed cam surface 65 is provided. This cam surface 65 serves as the drive source for operating the head driving mechanism 80. As the tape cassette 7 is pushed into the cassette attachment section 5 of the tape printing apparatus 1, the cam follower 27 of the tape printing apparatus 1 is displaced to the left as seen in FIG. 2.

In the vicinity of the lower end of the left-hand side as seen in FIG. 7 of the sides of the cassette main body 54, the cuter receiving section 66 for receiving the cutter 39 of the tape cutting mechanism 35 at the time of cutting the tape is provided so as to be opposed to the direction of movement of the cutting edge of the cutter 39. It is possible to form the cutter receiving section 66 of a hard rubber or the like and attach it to the cassette main body 54.

In those sections of the upper and lower surfaces of the cassette main body 54 which are nearest to the user, shown at the bottom in FIG. 7, operating recesses 67 having a substantially semi-circular plan-view configuration are formed so as to enable the user to grasp the cassette when attaching it to the apparatus (See FIG. 1).

Next, a tape-type recording medium to be used in the tape cassette of this embodiment will be described with reference to FIGS. 9 and 10.

Figure 9:
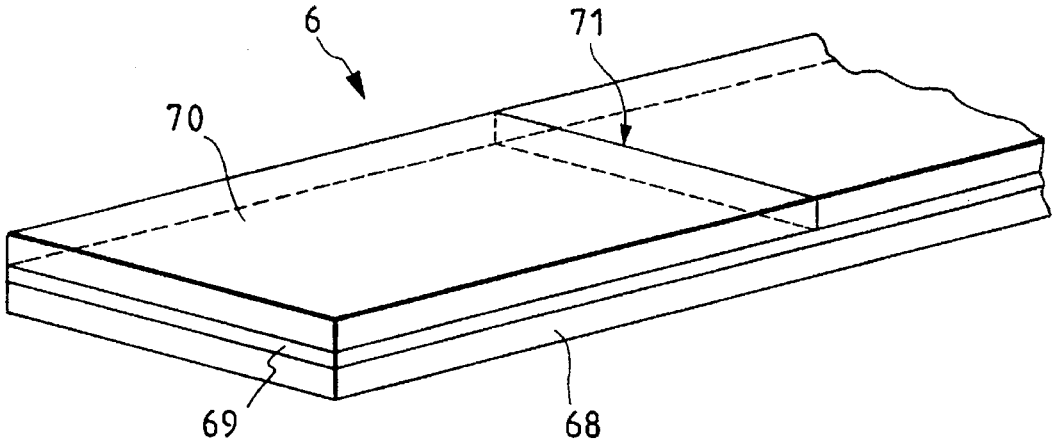
FIG. 9 is a perspective view showing the construction of a tape-type recording medium accommodated in a tape cassette according to the present invention.

As shown in FIG. 9, the tape-type recording medium 6 of this embodiment comprises a long, continuous thermosensitive paper 68, which develops color when heat is applied thereto. On one side of this thermosensitive paper 68, an adhesive layer 69 consisting of an appropriate adhesive is formed, and a separate paper 70 is glued to this adhesive layer 69.

In the above-mentioned separate paper 70, which is cut by a length smaller than, for example, the length of the label affixing section of a videos cassette or the like, cut sections 71, which are generally called "half-cuts", are formed.

Thus, when the tape-type recording medium 6 of this embodiment is bent toward the thermosensitive paper 68 side at a position between cut sections 71 of the separate paper 70, a cut section 71 of the separate paper 70 can be easily separated from the adhesive layer 69.

Figure 10:
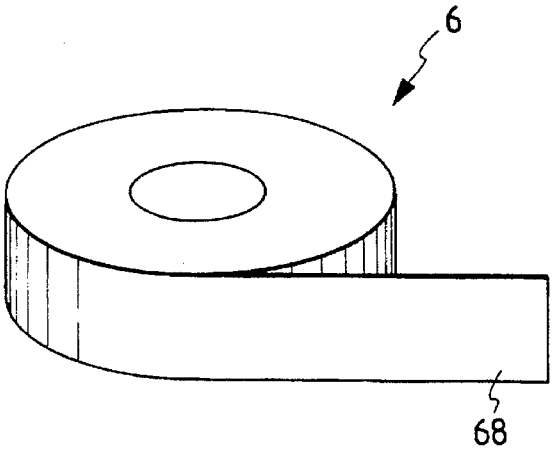
FIG. 10 is a perspective view showing a tape-type recording medium, which is to be accommodated in a tape cassette according to the present invention, in the rolled-up state.

As shown in FIG. 10, the tape-type recording medium 6 is rolled-up such that the thermosensitive paper is on the outer side.

Further, when an end indicating portion consisting of a message or an end mark for informing the user of the approaching of the tape to an end is provided by printing or the like on that section of the surface of the thermosensitive paper 68 which is on the inner peripheral side of the tape-type recording medium (the tape reel end section), the operator, drawing the tape-type recording medium 6 out of the tape cassette 7, can easily recognize the approach to an end of the tape-type recording medium 6, thereby preventing the tape-type recording medium 6 from running out in the middle of a printing operation.

Next, a VTR on which a tape printing apparatus of this embodiment is mounted will be described with reference to FIG. 11.

Figure 11:
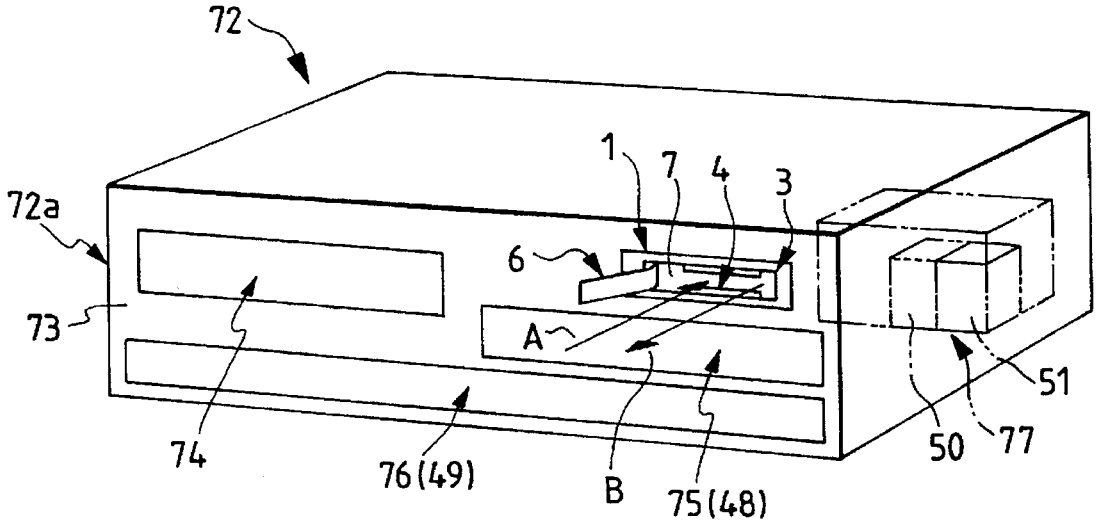
FIG. 11 is a perspective view for illustrating the construction of a VTR equipped with a tape printing apparatus using a tape cassette according to the present invention.

As shown in FIG. 11, in the VTR 72 of this embodiment, a video cassette insertion opening 74 for attaching a video cassette (not shown) is provided on a vertical front surface 73 of the apparatus, which constitutes the operating side of the apparatus main body 72*a*, and the tape printing apparatus 1 is arranged to the right (as seen in the drawing) of the video cassette insertion opening 74. Arranged on this apparatus front side 73 are an operating section 75 which performs various operations of the VTR and which also serves as the operating section 48 for making it possible to manually input printing information to the tape printing apparatus 1, and a display section 76 which serves to display the operating condition of the VTR, the time, etc., and which also serves as the display section 49 for displaying printing information input to the tape printing apparatus 1. In the VTR 72, as indicated by a phantom line in FIG. 11, there is arranged a control section 77 which consists of a CPU (not shown) for controlling the VTR, memory or the like and which at least includes the printing information storing section 50 for storing printing information input to the tape printing apparatus 1 and the printing control section 51 for selectively causing the heat generating elements, arranged on the thermal head 21, to generate heat on the basis of printing information and for controlling the driving motor 10.

Further, in the VTR 72 of this embodiment, broadcasting information, such as a title, transmitted in the form of sound and image, at the same time, by utilizing an available band, for example, of a television wave is received, and, on the basis of this information, the broadcasting information being recorded can be immediately printed on the tape-type recording medium 6 by means of the tape recording apparatus 1.

Next, the operation of this embodiment, constructed as described above, will be explained with reference to FIGS. 1 through 12.

In the tape cassette 7 of this embodiment, as indicated by the arrow A of FIG. 1, the tape cassette 7 is manually pushed into the cassette insertion opening 4 provided on the front side 3 of the tape printing apparatus 1, whereby the attachment of the tape cassette 7 to the tape printing apparatus is started. At this time, as indicated by the phantom line in FIG. 7, one end (the free end) of the tape-type recording medium 6, accommodated in the cassette 7, is drawn out from the tape outlet 58 by way of the tape guide 59 and travels on that section of the platen roller 60 exposed through the tape outlet 58.

When the attachment of the tape cassette 7 is started, the tape cassette 7 is gradually pushed into the internal case 8, which constitutes the tape attachment section 5, through the cassette insertion opening 4. In this process, the right and left sides of the tape cassette 7 are guided while being restricted by the left and right side plates 44 and 45 of the internal case 8, and the lower surface of the tape cassette 7 is guided while being supported by the bottom plate 43 of the internal case 8, so that the tape cassette 7 can be reliably pushed into the internal case 8, serving as the tape attachment section 5, through the cassette insertion opening 4, from the front side 3 of the tape printing apparatus 1.

Next, as the attachment (pushing-in) of the tape cassette 7 into the internal case 8 progresses, the cam surface 65 of the tape cassette 7, shown in FIG. 7, is brought into abutment with the cam follower 27, which constitutes a part of the head driving mechanism 80 provided on the upper surface of the forward end section of the sub-arm 26 of the head lever driving arm 23 shown in FIG. 2, and, as the attachment of the tape cassette 7 further progresses, the cam follower 27 is gradually displaced to the left as seen in FIG. 2.

Due to the displacement to the left of the cam follower 27 as a result of the progress in the attachment of the tape cassette 7, the head lever driving arm 23, which constitutes a part of the head driving mechanism 80, rotates clockwise around the rotation axle 24 against the biasing force of the biasing spring 32, which constantly biases the head lever driving arm 23 counterclockwise as seen in FIGS. 2 and 5. As a result of this clockwise rotation of the head lever driving arm 23, the torsion coil spring 29 rotates clockwise as seen in FIGS. 2 and 5, and one end (the lower end as seen in FIGS. 2 and 5) of the torsion coil spring 29 causes the forward end of the back arm 20 of the head lever 18 to move to the left as seen in FIGS. 2 and 5. As the forward end of the back arm 20 is thus caused to move to the left by the torsion coil spring 29, the head lever 18 rotates counterclockwise as seen in FIGS. 2 and 5 around the support axle 17, and the thermal head 21, provided on the upper surface of the free end section of the front arm 19 of the head lever 18 is brought into abutment with the exposed section of the outer peripheral surface of the platen roller 60, arranged in the tape outlet 58 of the tape cassette 7, shown in FIG. 7, through the intermediation of the tape-type recording medium 6.

Thus, as the operation of attaching the tape cassette 7 progresses (or in an interlocked relationship therewith), the cam surface 65 causes the thermal head 21 to abut the outer peripheral surface of the platen roller 60 through the intermediation of the tape-type recording medium 6.

When the tape cassette 7 is taken out of the cassette attachment section 5, the head driving mechanism 80 operates so as to separate the thermal head 21 from the outer peripheral surface of the platen roller 60 due to the biasing force of the biasing spring 32.

Further, since the thermal head 21 can be brought into abutment with the platen roller 60 through the intermediation of the tape-type recording medium 6 due to the biasing force of the torsion coil spring 29, the force with which the thermal head 21 and the platen roller 60 are held in press contact with each other can be constantly kept at a level suitable for printing, thereby making it always possible to obtain high printing quality.

The attachment of the tape cassette 7 is completed when the protrusion 64 provided so as to be exposed on the lower side of the cassette main body 54 of the tape cassette 7 has been engaged with the engagement protrusion 34 protruding from the bottom surface 9 of the main body 2 of the printing apparatus 1 and the platen driving gear 63, arranged coaxially with the platen roller of the tape cassette 7, has been connected with the output gear 15, which constitutes a part of the driving force transmitting mechanism 16 and the tape running mechanism 81, provided on the bottom surface 9 of the main body 2 of the tape printing apparatus 1.

That is, the driving force transmitting mechanism 16 and the tape running mechanism 81 are constructed such that, as the operation of attaching the tape cassette 7 progresses, the output gear 15, which forms a part of the driving force transmitting mechanism 16 and the tape running mechanism 81, is connected with the platen driving gear 63, making it possible for the driving force of the driving motor 10 to be transmitted to the platen roller 60, which rotates integrally with the platen driving gear 63 of the tape cassette 7.

Figure 12:
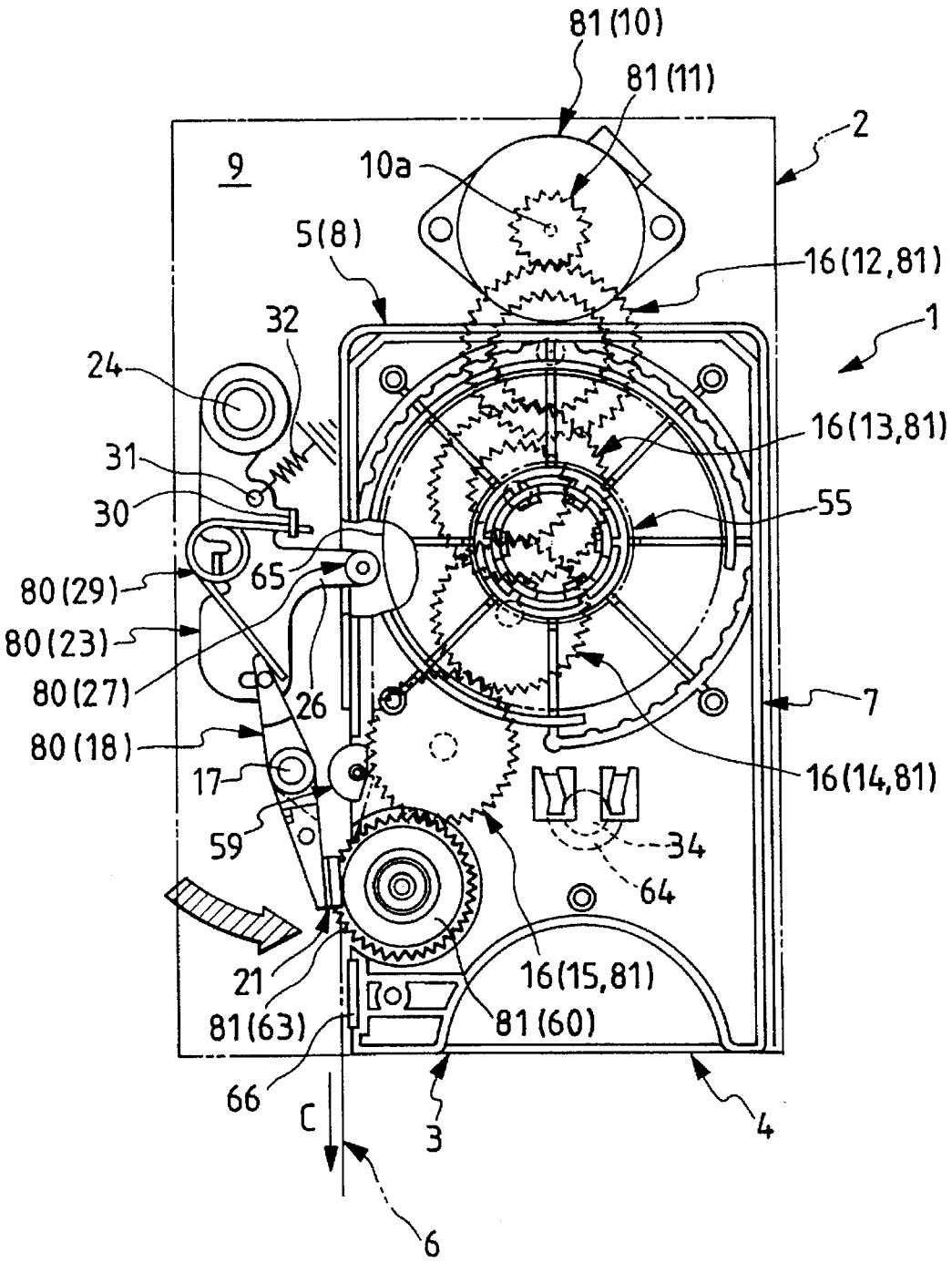
FIG. 12 is a plan view showing the inner construction of the essential part of a tape cassette according to an embodiment of the present invention attached to a tape printing apparatus.

Further, when the attachment of the tape cassette 7 is completed, the substantially U-shaped elastic protrusion 64 is fitted onto the outer peripheral surface of the engagement protrusion 34 of the tape printing apparatus 1, whereby the positioning of the tape cassette 7, attached to the cassette attachment section 5, is effected and, further, by virtue of the resultant click, the operator can make sure that the attachment of the tape cassette 7 to the cassette attachment section 5 has been completed, thereby allowing the tape cassette 7 to be reliably attached to the cassette attachment section 5. FIG. 12 shows the condition in which the attachment of the tape cassette 7 to the interior of the internal case 8, serving as the cassette attachment section 5 of the tape printing apparatus 1, has been completed.

Further, in this embodiment, the thermal head 21 is brought into abutment with the platen roller 60 through the intermediation of the tape-type recording medium 6 immediately before the attachment of the tape cassette 7, and immediately before the platen driving gear 63, arranged coaxially with the platen roller 60, is connected with the output gear 15 arranged on the bottom surface 9 of the main body 2 of the tape printing apparatus 1. Due to this construction, the tape cassette 7 is pushed into the internal case 8, with the thermal head 21 abutting the platen roller 60 through the intermediation of the tape-type recording medium 6, and, due to the abutting force of the thermal head 21, the platen roller 60 is pushed in while rotating counterclockwise as seen in FIG. 7, so that, as the platen roller 60 rotates, the platen driving gear 63 is connected (engaged) with the output gear 15 while rotating, whereby it is possible to reliably prevent damage due to collision between the teeth (not shown) of the platen driving gear 63 and the output gear 15 when the cassette is attached to the printing apparatus, and to reliably prevent a reduction in service life of the platen driving gear 63 and the output gear 15. Further, the attachment of the tape cassette 7 to the interior of the internal case 8, serving as the cassette attachment section 5 of the tape printing apparatus 1, is made positively smooth, resulting in a substantial improvement in terms of operability.

Next, when, in the condition in which the cassette is attached to the apparatus, printing operation is started, the driving motor 10 of the tape running mechanism 81 is driven by a control command from the printing control section 51, and the driving force of the driving motor 10 is transmitted to the platen driving gear 63 through the driving force transmitting mechanism 16, with the result that the platen roller 60 rotates integrally with the platen driving gear 63, with the tape-type recording medium 6, held between the thermal head 21 and the platen roller 60, being paid out in the tape running direction indicated by the arrow C in FIG. 12. As the tape-type recording medium 6 runs, the plurality of heat generating elements (not shown) of the thermal head 21 are selectively caused to generate heat by a control command from the printing control section 51, whereby the thermosensitive paper 68 of the tape-type recording medium 6, which abuts the thermal head 21, develops color, thereby printing desired characters or the like on the tape-type recording medium 6. After this, the tape-type recording medium 6 is paid out from the tape cassette 7 by a predetermined length, which, in this embodiment, is a length suitable for the affixment to a video cassette (not shown), thereby completing the printing operation.

Then, the portion of the tape-type recording medium 6, which has been paid out from the tape cassette 7 and undergone printing, is cut off in a direction perpendicular to the longitudinal dimension of the tape-type recording medium 6 by operating the cutter lever 37 of the tape cutting mechanism 35. Then, the portion of the tape-type recording medium 6 which has been thus cut off easily allows separation of the separate paper 70 from the adhesive layer 69 to be effected without using any tool but simply by bending it toward the thermosensitive paper 68 side due to the construction in which the cut sections 70, generally called "half-cuts", are formed at intervals smaller than the cutting length of the tape-type recording medium 6.

From this onward, the tape-type recording medium 6 is successively paid out from the tape cassette 7 for each printing operation. In this embodiment, when the tape-type recording medium 6, paid out from the tape cassette 7, approaches its end, the end indicating portion (not shown) consisting of a message or an end mark provided at the end of the tape-type recording medium 6 is exposed to thereby enable the operator to easily recognize the approach of the end of the tape-type recording medium 6, thereby making it possible to prevent the tape-type recording medium 6 from running out in the middle of a printing operation.

When the end indicating portion (not shown), consisting of a message or an end mark, provided at the end of the tape-type recording medium 6, is exposed, the tape cassette 7 is taken out by grasping and drawing the operating recesses 67 of the tape cassette toward the user, as indicated by the arrow B of FIG. 1, whereby the cassette is extracted and replaced by a new tape cassette 7.

In the case in which the upper and lower cover cases 52 and 53 of the tape cassette 7 are detachable, it is possible to adopt an arrangement in which, when the tape-type recording medium 6 has been consumed, a new tape-type recording medium is wound around the tape reel 55, or the tape reel 55 is replaced by a new one, whereby a substantial reduction in cost can be achieved although this arrangement requires longer time as compared with the case in which the tape cassette 7 is replaced by a new one.

As described above, the tape cassette 7 of this embodiment is formed such that a side surface thereof faces the front side 3 of the main body 2 of the associated tape printing apparatus 1 and that it is detachable from the front side 3 of the main body 2 of the tape printing apparatus 1, so that it is possible for the tape printing apparatus 1 to be reduced in the height of its front side 3. Further, the attachment and detachment of the tape cassette 7 can be effected in a small operating space. Thus, even when the tape printing apparatus 1 is installed inside a rack or the like, the attachment and detachment of the tape cassette to and from the the tape printing apparatus 1 can be easily effected.

Further, the tape cassette 7 of this embodiment is formed such that a side surface thereof faces the front side 3 of the main body 2 of the tape printing apparatus 1 and is detachable from the front side 3 of the main body 2 of the tape printing apparatus 1, so that, as shown in FIG. 11, when the printing apparatus is mounted in the VTR 72, it is possible to provide the cassette insertion opening 4 of the tape printing apparatus 1 on the front surface 73 of the apparatus and to arrange, on this apparatus front side 73, an operating section 75 which performs various operations of the VTR and which also serves as the operating section 48 for making it possible to manually input printing information to the tape printing apparatus 1 and a display section 76 which serves to display the operating condition of the VTR, the time, etc., and which also serves as the display section 49 for displaying printing information input to the tape printing apparatus 1. Thus, it is possible to prevent the area of front surface 73 of the VTR 72 from becoming excessively large, and the attachment and detachment of the tape cassette 7 to and from the tape printing apparatus 1 can be easily performed from the front side 73 of the apparatus even when the VTR 72 is installed inside a rack or the like.

Thus, the tape cassette 7 of this embodiment requires only a small space for its attachment and detachment, so that it is suitable for an integral association with various apparatuses, such as TV or VTR.

As described above, in the tape cassette of the present invention, the front surface of the associated tape printing apparatus and a side surface of the tape cassette face each other, and the tape cassette is detachable from the tape printing apparatus, so that a reduction in the height of the front surface of the tape printing apparatus can be achieved. Further, it is advantageously possible for the tape cassette to be attached and detached in a small operating space.

What is claimed is:

1. A tape cassette for loading and use in a tape printing apparatus, the tape apparatus being equipped with a printing head, a head positioning mechanism for positioning said printing head, a driving motor and a driving force transmission mechanism for transmitting a driving force of said driving motor, said tape cassette comprising:

a cassette case;

a tape-type recording medium accommodated in the cassette case and having an end portion extending through an opening formed in the cassette case;

a platen roller rotatably mounted in the cassette case adjacent the opening; and a cam surface formed on a surface of said cassette case, the cam surface being shaped to cooperatively engage said head positioning mechanism such that when the tape cassette is loaded into the tape printing apparatus, the printing head is press-contacted against said platen roller with the end portion of the tape-type recording medium located therebetween.

2. The tape cassette according to claim 1, further comprising a platen driving gear connected to said platen roller, the platen driving gear being positioned on an external portion of the cassette case in a location such that when the rear portion of the cassette case is inserted through the insertion slot of the tape printing apparatus and the cassette case is pushed into the tape printing apparatus, the platen driving gear meshes with the driving force transmission mechanism.

3. A tape cassette for use with a tape printing apparatus, the tape printing apparatus having an insertion slot, a printing head mounted adjacent the insertion slot, a head positioning mechanism for adjusting a position of the printing head, said tape cassette comprising:

a cassette case including a front portion, a rear portion and a side portion extending from the front portion to the rear portion;

a tape-type recording medium accommodated in the cassette case and including an end portion which extends through an opening formed in the side portion adjacent the front portion;

a platen roller rotatably mounted adjacent the opening; and a cam surface formed on the side portion of the cassette case adjacent the rear portion;

wherein the cam surface is shaped to cooperatively actuate the head positioning mechanism such that when the rear portion of the cassette case is inserted through the insertion slot of the tape printing apparatus, the head positioning mechanism pushes the printing head against the platen roller with the end portion of the tape-type recording medium pinched therebetween.

4. The tape cassette according to claim 3, wherein the tape printing apparatus further includes a driving motor and a driving force transmission mechanism for transmitting a driving force of said driving motor, and wherein said tape cassette further comprises a platen driving gear connected to said platen roller, the platen driving gear being positioned on an external portion of the cassette case in a location such that when the rear portion of the cassette case is inserted through the insertion slot of the tape printing apparatus and the cassette case is pushed into the tape printing apparatus, the platen driving gear meshes with the driving force transmission mechanism.

* * * * *